US005558725A

United States Patent [19]

Schnatbaum et al.

[11] Patent Number: 5,558,725

[45] Date of Patent: Sep. 24, 1996

[54] PROCESS FOR CARBURIZING WORKPIECES BY MEANS OF A PULSED PLASMA DISCHARGE

[75] Inventors: Frank Schnatbaum, Braunschweig; Albrecht Melber, Darmstadt, both of Germany

[73] Assignee: ALD Vacuum Technologies GmbH, Erlensee, Germany

[21] Appl. No.: 498,216

[22] Filed: Jul. 5, 1995

[30] Foreign Application Priority Data

Aug. 6, 1994 [DE] Germany ..... 44 27 902.7

[51] Int. Cl.[6] ..... C23C 8/20

[52] U.S. Cl. ..... 148/222

[58] Field of Search ..... 148/222

[56] References Cited

U.S. PATENT DOCUMENTS 4,490,190 12/1984 Speri ..... 148/16.6

5,127,967 7/1992 Verhoff ..... 148/222

5,383,980 1/1995 Melber et al. ..... 148/222

FOREIGN PATENT DOCUMENTS 601847 8/1934 Germany .

*Primary Examiner*—Deborah Yee

*Attorney, Agent, or Firm*—Felfe & Lynch

[57] ABSTRACT

Workpieces of carburizable materials, especially steels, are carburized by means of a pulsed plasma discharge in a carbon-containing atmosphere at pressures of 0.1–30 mbars and at pulsed voltages of 200–2,000 V, preferably of 300–1,000 V. A continuously applied baseline voltage, which is below the breakdown voltage, is superimposed on the pulsed voltage. The baseline voltage is preferably a direct-current voltage, which is in the range of 10–150 V, preferably of 20–100 V.

9 Claims, 3 Drawing Sheets

I
V
t1
t2
t

I
V
Vg
21
t1
t2
t

PROCESS FOR CARBURIZING WORKPIECES BY MEANS OF A PULSED PLASMA DISCHARGE

BACKGROUND OF THE INVENTION

The invention pertains to a process for the carburizing of workpieces of carburizable materials, especially steels, by means of a pulsed plasma discharge in a carbon-containing atmosphere at pressures of 0.1–30 mbars and at pulsed voltages of 200–2,000 V, preferably of 300–1,000 V.

In a process of this type known from EP 552 460 A1, the voltage at the electrodes during the so-called pauses between the pulses is zero, the electrodes consisting of at least one electrode on the machine side and the workpieces or the holder of the workpieces on the other side. That is, the process is operated without a so-called baseline voltage.

Not only ferrous materials but also nonferrous materials such as titanium are included among the materials which can be carburized.

When structural parts of steel are carburized in a pulsed glow discharge (plasma), an intense flow of carbon is created at the start of the carburizing operation, so that the carbon content at the edge of the structural component increases as rapidly as possible to values just below the saturation limit. As a result, the steepest possible carbon gradient is created in the component at the start of the treatment, which has positive effects on the properties of the finished products.

The flow of carbon depends on the parameters of the plasma. To generate a high carbon flow, the amount of power which is introduced into the plasma must be on a correspondingly high level. The electric current which develops in the plasma during a pulse depends on the surface area of the components to be treated and usually reaches orders of magnitude of 25 A/m$^2$ of surface area. For the treatment of large batches, it is therefore necessary to use generators with pulse outputs of more than 200 A at voltages of 500–1,000 V. The corresponding outputs must be switched on an off at intervals in the range of about 10–100 μs. Generators with outputs of this sort are not available on a production-line basis; these are expensive, custom-made machines.

It is known from DE-PS 601 847 that, when individual workpieces of metal are hardened by gas diffusion under additional heating and the action of a pulsed plasma, the duration of the pauses between the individual surge pulses should be selected so that the gas can undergo deionization; these intervals are usually at least ten times longer than the surge pulses themselves. This means that the ionization must be built up again each time from an energy level of zero. For example, the pulse frequency can be 10 Hz and the average current 100 mA.

When the workpieces are subjected to supplemental heating in the conventional manner, U.S. Pat. No. 4,490,190 informs us that, by means of an appropriately high frequency of short pulses with long pauses between them, it is possible to generate a cold plasma, which has the effect of disconnecting the heating action of the plasma from its thermochemical effect on the workpieces. As a result, it is possible to avoid thermal .damage to the workpieces. No measures for preserving some of the ionization during the pauses between the pulses are stated, however, it can be assumed that the treatment time is relatively long and/or that the penetration of the gases is relatively shallow. Neither the size of the workpieces, the size of the batch, the current density, nor the total current is stated.

The invention is therefore based on the task of generating higher carbon flows with the use of relatively small generators and thus to reduce the investment and operating costs of a system for implementing the process.

SUMMARY OF THE INVENTION

According to the invention, a continuously applied baseline voltage, which is below the breakdown voltage, is superimposed on the pulsed voltage.

The breakdown voltage is the voltage at which, under the given parameters in the device, a plasma can be ignited. If no plasma is ignited when the baseline voltage is applied to the electrodes, the condition according to the invention is satisfied and can be monitored.

It is advantageous for the baseline voltage to be in the range between 2% and 35% of the pulsed voltage, especially when, as the baseline voltage, a direct voltage with values of 10–150 V, preferably of 20–100 V, is selected.

The pulse frequency is not a highly critical limit; advantageous results have been obtained at a pulse frequency of 15 kHz.

The ratio of the pulse time $t_1$ to the pause time $t_2$ is also not extremely critical; it is advantageous for this ratio to be in the range between 4:1 and 1:100. It is especially advantageous for the pulse time to be between 50 and 200 μs and for the pause time to be between 500 and 2,000 μs.

DETAILED DESCRIPTION OF THE PREFERRED EMBODIMENT

Figure 1:
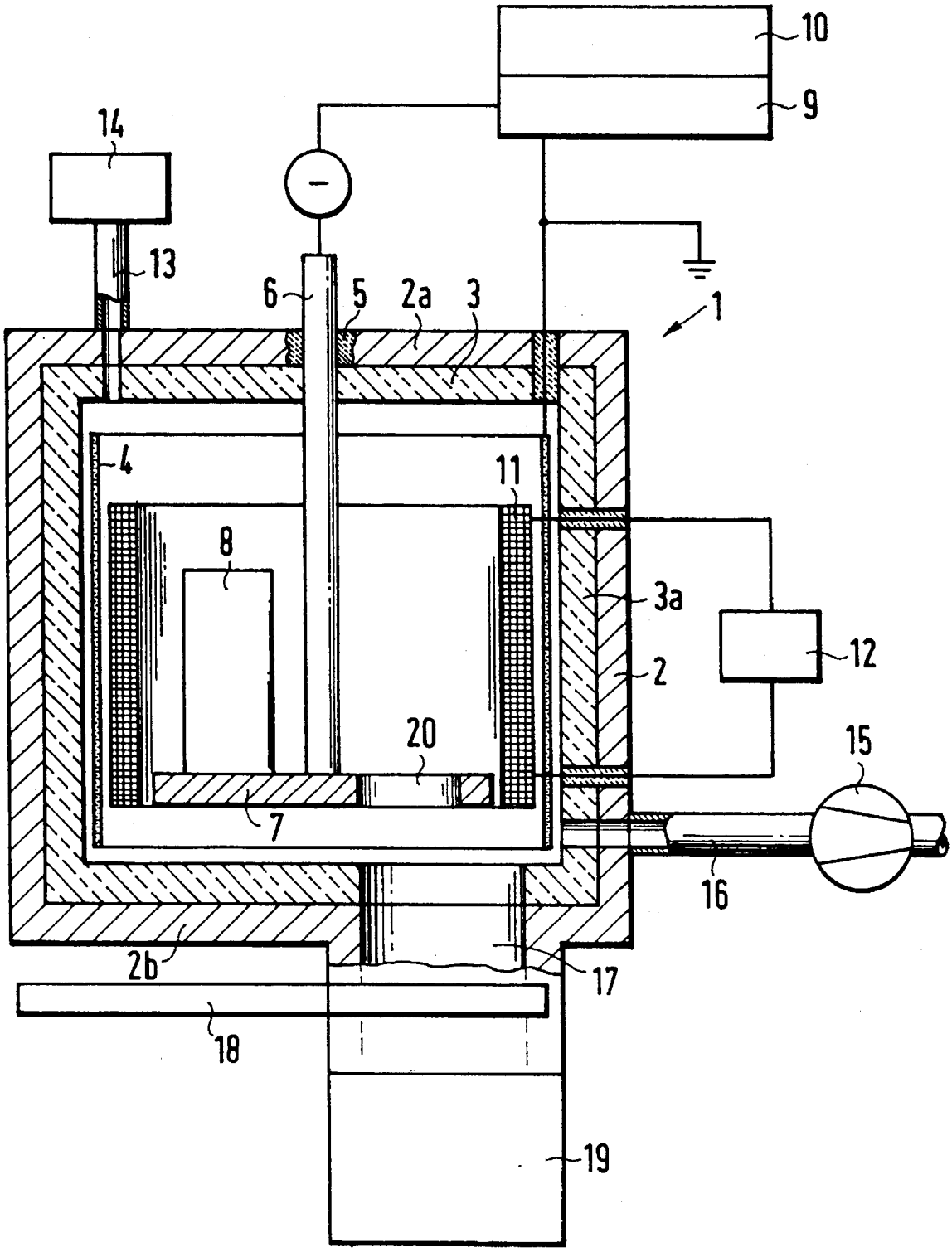
FIG. 1 shows a schematic diagram of a device for implementing the process according to the invention.

FIG. 1 shows a vertical cross section through a device for implementing the process according to the invention, the essential part of which is a vacuum furnace 1 with a furnace chamber 2, which is lined with thermal insulation 3. In front of side walls 3*a* of thermal insulation 3 there is a grounded electrode, which serves as an anode 4 of an electric circuit. A vertical support rod 6, which carries at its bottom end a plate-shaped, horizontal workpiece holder, which also has the function of an electrode and serves as cathode 7, passes through furnace cover 2*a* by means of an insulating bushing 5. Only one of the workpieces 8 on this workpiece holder is shown.

Anode 4 and cathode 7 are connected to a power supply 9, which serves to generate voltage pulses to form the plasma. Power supply 9 has a control unit 10, by means of which the electrical process parameters for controlling the plasma can be set. In particular, power supply 9 supplies not only the pulses but also a continuously applied baseline voltage, which is superimposed on the pulses. Both the intensity of the pulses and the level of the baseline voltage can be adjusted by means of the control unit.

Cathode 7 and workpieces 8 are surrounded concentrically by a resistance heating element 11, which is connected to an adjustable power source 12. The energy balance of the furnace and therefore the temperature of the workpieces are determined first by the losses and second by the sum of the energy inputs from the plasma and the radiation of the resistance heating element.

A supply line 13, which is connected to a controllable gas source 14 and through which the desired process gases or gas mixtures are supplied, leads into furnace chamber 2. The gas balance is determined by the gas feed, the consumption by the workpieces, possibly by loss sinks, and, of course, by the influence of vacuum pump 15, which is connected by way of a vacuum line 16 to furnace chamber 2 and which can also be designed as a battery of pumps.

In floor 2*b* of furnace chamber 2 there is an opening 17, which can be sealed by a shutoff slide valve 18, and connected in a vacuum-tight manner underneath there is a heated fluid tank 19, containing a quenching fluid. Above opening 17, in cathode 7, there is an opening 20, through which workpieces 8 can be lowered into the quenching fluid by means of a manipulator (not shown). The way in which this device operates can be derived from the general description and from the exemplary embodiment.

Figure 2:
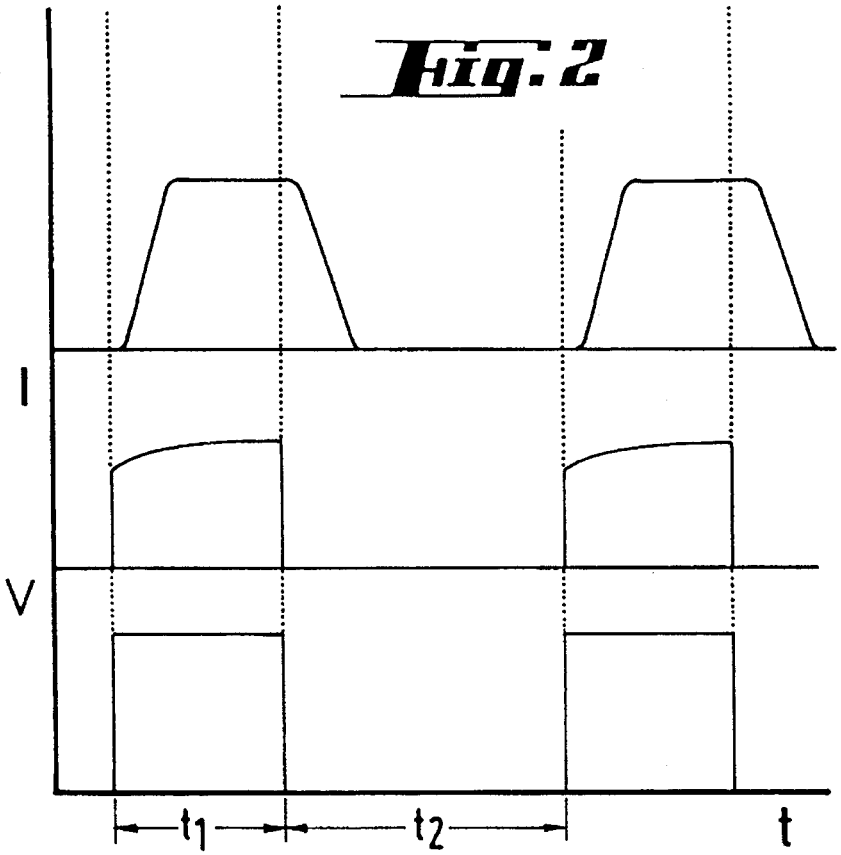
FIG. 2 shows a diagram which explains a pulsed plasma process according to the state of the art.
Figure 3:
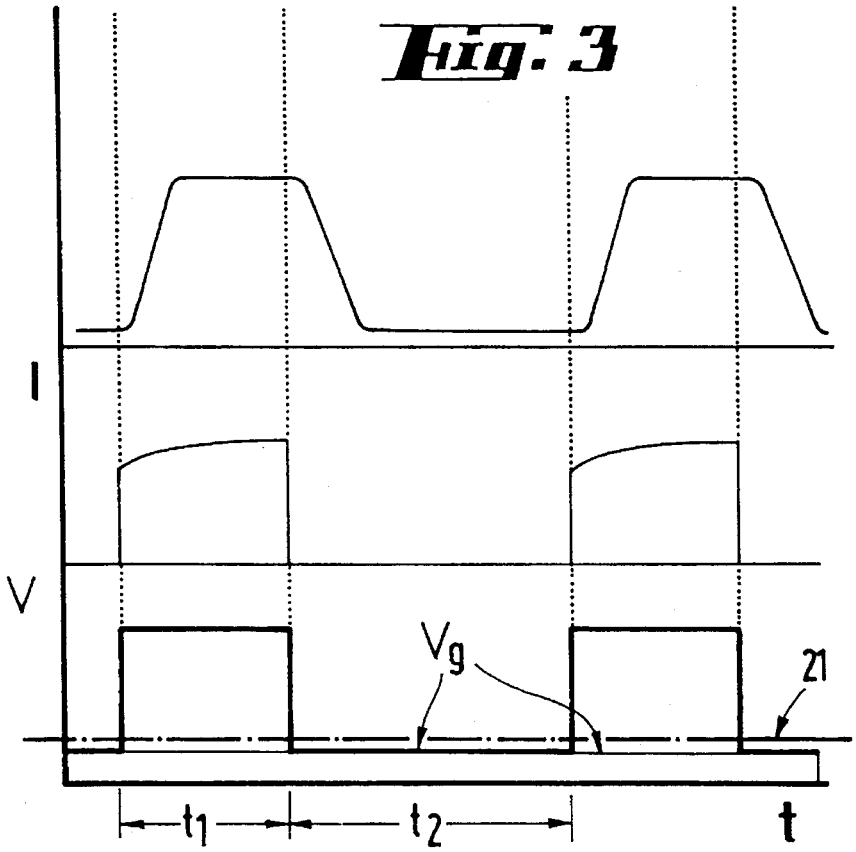
FIG. 3 shows a diagram which explains the pulsed plasma process according to the invention.

FIGS. 2 and 3 show the time t, plotted on the abscissa; $t_1$ characterizes the duration of the pulses, and $t_2$ describes the pauses between pulses. Each graph contains, one above the other, the associated pulse voltage V, the current I flowing during a pulse, and a curve which symbolizes the state of excitation caused by ionization and dissociation and the deexcitation caused by recombination. FIG. 3 shows not only the pulse voltage but also the baseline voltage, which is below the so-called breakdown voltage, represented by a dash-dot line 21.

When, according to FIG. 2, a pulsed, direct voltage without superimposed baseline voltage is used, hydrocarbon molecules, which are fed in through supply line 13, are excited during the course of a voltage pulse. These hydrocarbon molecules become dissociated and ionized. As a function of the amplitude of the voltage being used and the duration of the voltage pulses being applied, the intensity of the excitation and the extent of the dissociation and ionization of the particles vary, and a corresponding current I, which is indicated by the middle curve in FIG. 2, begins to flow. During the pause between the pulses, that is, in the period of time $t_2$ during which no voltage is being applied, recombination processes are dominant, and the excited species fall back to energy levels in which they contribute little or nothing to the carburizing process or to a process of layer formation. This can be seen from the upper curve in FIG. 2, in which curve segments nearly coinciding with pauses $t_2$ between the pulses have a value of 0.

The recombination processes and the fallback from a high-energy to more stable or lower-energy states require time. By varying the voltage and the pulse duration (corresponding to the extent and intensity of the excitation, dissociation, and ionization) and the pause duration (corresponding to the recombination and deexcitation) between the voltage pulses, the flow of carbon can be effectively controlled.

FIG. 3 shows, on the basis of the lower curve, the superimposition according to the invention of a continuously applied baseline voltage $V_g$, which is below the breakdown voltage shown by line 21, which is itself dependent on the given process parameters, and a pulsed direct voltage of several times the baseline level. This has an effect on the excitation, dissociation, and ionization processes as well as on the relaxation and recombination. Because the continuously applied baseline voltage $V_g$ is below the breakdown voltage, no current flows during the pauses between pulses of the pulsed direct voltage, as can be seen from curve I in FIG. 3.

Consequently, there is no need for a an electric arc detector when a continuous baseline voltage is used, because no plasma is generated by this baseline voltage. Because of the baseline voltage, however, the excited species do not fall back during the pauses between the direct voltage pulses to the same low-energy states which are present in the pauses without a superimposed voltage (FIG. 2). As a result of the measure according to the invention, the excited species are held in higher-energy states, and from these states the species in question can be more easily excited, ionized, and dissociated during the next pulse. At the same voltage, pulse duration, and pause duration, therefore, higher carbon flows can be generated than those obtained according to the state of the art without a superimposed baseline voltage, as illustrated in FIG. 4.

Figure 4:
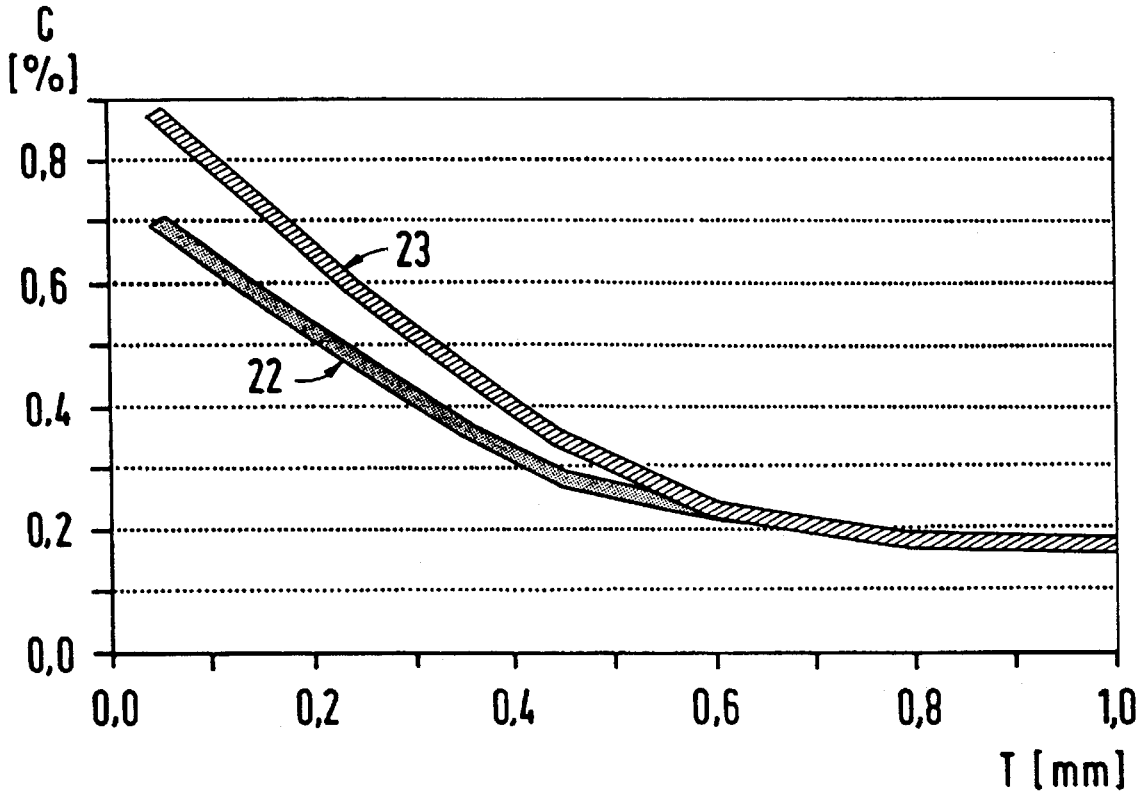
FIG. 4 shows an additional diagram with a comparison of the process according to the state of the art with that according to the invention.

In FIG. 4, the distance T from the surface of the structural component is shown on the abscissa, the surface being designated "0.0". The carbon content C is shown in percent on the ordinate. Lower curve 22 shows the relationships which occur when a pulsed direct voltage is applied without a superimposed baseline voltage, whereas curve 23 shows the relationships which occur when a continuous baseline voltage is superimposed on the pulsed direct voltage. A much higher carbon content is therefore obtained both at the surface and also at a depth of up to 0.5 mm. The following conditions were selected: The pulsed direct voltage was 600 V; the ratio of pulse time $t_1$ to pause time $t_2$ was 1:10; and the level of the continuously applied baseline voltage was 100 V.

EXAMPLE

In a device according to FIG. 1 with fan effective volume inside resistance heating element 11 of 0.25 $m^3$, a plurality of cylindrical bolts with a length of 150 mm and a diameter of 16 mm of the alloy 16MnCr5 were exposed for 120 minutes to a pulsed direct voltage of 600 V and a baseline voltage of 100 V. The pulse time was $t_1$=100 μs, and the pause time was $t_2$=1,000 μs. The composition of the gas mixture supplied through supply line 13 was 10 vol. % argon, 10 vol. % methane, and 80 vol. % hydrogen. Under these conditions, the result according to curve 23 in FIG. 4 was achieved. If there is no need to achieve a higher carbon content, the process according to the invention leads to much faster carburization, both at the surface and also below it. Nevertheless, smaller voltage and power sources can be used.

It is claimed:

1. Process for carburizing a workpiece comprising placing a workpiece of carburizable material in a chamber, introducing a carbon-containing atmosphere at a pressure of 0.1–30 mbars into said chamber, igniting a plasma in said chamber by means of a pulsed voltage during pulse times $t_1$ which are separated by pause times $t_2$, said pulsed voltage being 200–2000 V, and maintaining a positive baseline voltage during said pause times, said baseline voltage being below a breakdown voltage at which the plasma can be ignited.

2. Process as in claim 1 wherein said pulsed voltage is 300–1000 V.

3. Process as in claim 1 wherein said baseline voltage is 2 to 35% of the pulsed voltage.

4. Process as in claim 1, wherein said baseline voltage is 10–150 V.

5. Process as in claim 4 wherein said baseline voltage is 20–100 V.

6. Process as in claim 1 wherein the ratio $t_1:t_2$ is between 4:1 and 1:100.

7. Process as in claim 1 wherein said pulse time $t_1$ is 50–200 μs and the pause time $t_2$ is 500–2000 μs.

8. Process as in claim 1 wherein said atmosphere consists of 2–50 vol. % argon, 3–50 vol. % hydrocarbon gas, remainder hydrogen.

9. Process as in claim 1 wherein said atmosphere consists of 10–30 vol. % argon, 10–30 vol. % hydrocarbon gas, remainder hydrogen.

* * * * *